United States Patent [19]

Flaum et al.

[11] 4,180,190

[45] Dec. 25, 1979

[54] VACUUM BAG PROCESS AND APPARATUS

[76] Inventors: Dennis M. Flaum, 1 E. Schiller, Chicago, Ill. 60610; Herman L. Fleishman, 6518 N. Kenton, Lincolnwood, Ill. 60645

[21] Appl. No.: 796,756

[22] Filed: May 13, 1977

[51] Int. Cl.[2] ..... A41H 43/00

[52] U.S. Cl. ..... 223/43

[58] Field of Search ..... 223/39, 43; 15/304; 49/360

[56] References Cited

U.S. PATENT DOCUMENTS

| | | | |
|---|---|---|---|
| 964,959 | 7/1910 | Ermentrout | 223/43 |
| 1,104,668 | 7/1914 | Herbst | 223/43 |
| 1,437,025 | 11/1922 | Schulz | 223/43 |
| 3,131,839 | 5/1964 | Norman et al. | 223/43 |
| 3,714,737 | 2/1973 | Fillion et al. | 49/360 |
| 3,938,282 | 2/1976 | Goyal | 49/360 |

*Primary Examiner*—George H. Krizmanich

*Attorney, Agent, or Firm*—Alter and Weiss

[57] ABSTRACT

A vacuum chamber has a port communicating with the interior of the chamber, and a blower and ducting for selectively establishing a vacuum within the chamber. A partially completed bag of seamed panel construction is placed with the port extending into the bag. When vacuum is applied, the bag is passed through the port, being thereby turned inside out. A pneumatically-controlled door enables access to the chamber for removal of the bag.

2 Claims, 4 Drawing Figures

VACUUM BAG PROCESS AND APPARATUS

This invention relates to apparatus and methods for facilitating the manufacture of cloth articles to be stuffed with a filling material. More particularly, the invention relates to apparatus and methods for readying a partially completed article of stuffed furniture for the insertion of stuffing material therewithin.

Contemporary manufacturers of furniture have long since ceased to be bound by traditional methods of manufacture, requiring rigid frames upon which or from which cushioned or resilient seat cushions are supported. One example of such contemporary "free-form" furniture is the beanbag chair. In its simplest form, the beanbag chair is a large, loosely stuffed bag which conforms to the body contours of the person seated thereon. For purposes of comfort or alteration of seating position, the shape of the bag may be changed simply by "plumping" the bag to redistribute the bean-like stuffing therewithin. Typically, the stuffing comprises a number of small foamed plastic "beans" which, in bulk, provide a resilient, deformable filling for the outer covering of the chair. Use of the beanbag concept has proven extremely popular and is no longer limited to the construction of furniture per se. In fact, cushions, toys and other such articles, once typically formed from rigidly constructed frames over which padding or other material was placed, have been adapted to the beanbag concept.

Construction of beanbags presents unique difficulties. Such bags are typically formed from heavy vinyl or other fabric-like material cut, in panels, from flat stock. The panels are then assembled to form a hollow, bag-like construction within which the beans are placed. Such chairs have typically no supporting framework and, as a consequence, the seams at which the panels are joined together must be of exceptional strength to withstand the rigors of use to which articles of furniture are typically put.

Overlapping panels at each such seam provide required strength and durability; however, this technique produces a seam which is exposed to view, making the final construction unattractive. Thus, after the panels have been seamed together, the resulting bag-like construction is turned inside out prior to stuffing. The seams thus presented are even, and the overlapping panel edges are hidden from view. After the stuffing is placed within the bag, the remaining opening is closed, either by stitching or through use of fasteners, such as zippers.

In constructing such furniture articles, it is often desirable to have the opening through which the stuffing is inserted to be as small as is practicable. This technique often makes it extremely difficult and awkward to manually turn a finished seamed bag inside out after seaming has been completed. Often, such bags can be manually reversed only by use of exceptional strength and effort. This is of particular importance when stuffing is inserted into the bag because the bag must be completely and fully turned inside out in order to enable the stuffing to completely fill the bag and maintain its shape. While techniques have been developed to speed up the manufacture of such bags, such as automatic systems to meter the amount of stuffing to be placed in each bag and automatic packaging devices used to ready the individual bags for sale and shipment, it has been found that this particular required step of turning the bags inside out has heretofore been a manual operation, which causes a bottleneck in the production process.

Accordingly, the present invention has the following objects:

To provide methods and apparatus for simply and conveniently turning finished, seamed panel bags inside out;

To accomplish such an operation using simply constructed vacuum operated apparatus;

To provide such apparatus in forms adaptable to many different sizes of bag constructions;

To provide such apparatus and methods functioning in a preselected automatic sequence of steps; and To provide such methods and apparatus in forms economical to produce and easy to operate.

These and further objects will become more apparent upon consideration of the accompanying drawings, in which.

Figure 2:
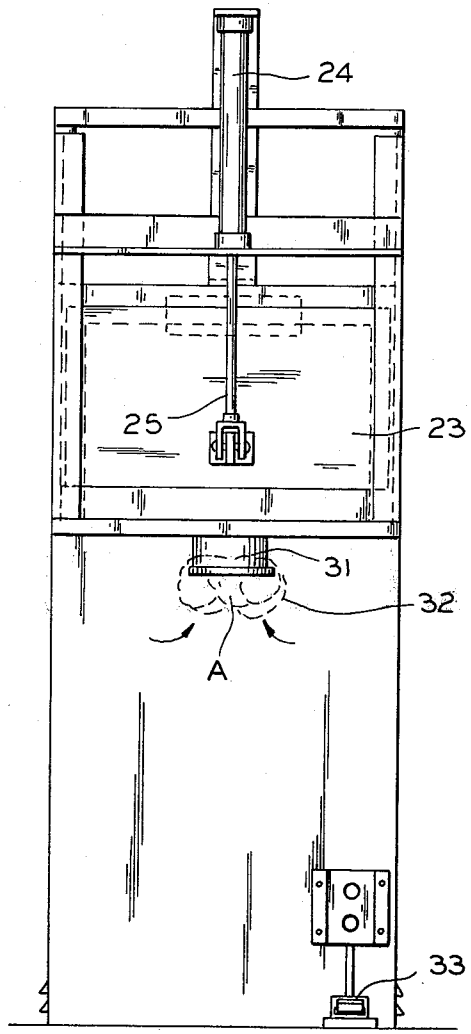
FIG. 2 is a front elevation illustrating placement of a bag.

Consistent with the foregoing objects, vacuum-operated apparatus 10 is provided, having vacuum chamber 13, with entry port 26 formed therethrough, having collar extension 31 about which bag 32 may be placed. Blower 14 is selectively operable to create a partial vacuum within chamber 13 by exhausting air through port 17 and duct 12, thereby drawing bag 32 through port 26 to turn bag 32 inside out. Exit door 24 is then raised to enable removal of bag 32.

Figure 1:
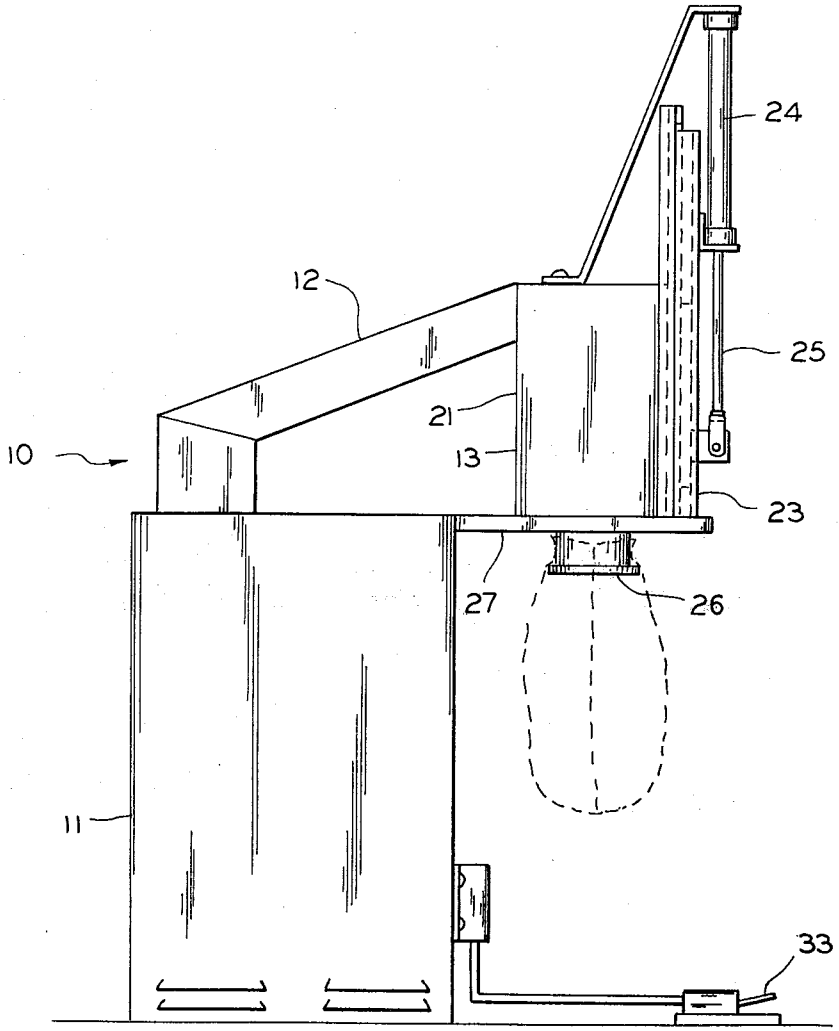
FIG. 1 is a side elevation of the invention.

Referring now to FIG. 1, the numeral 10 indicates, generally, a vacuum-operated bag reversing apparatus having a lower housing 11, a vacuum duct 12, and a vacuum chamber 13. As illustrated best in FIG. 3, lower chamber 11 serves as a housing for blower motor 14 and fan housing 15, connected to vacuum duct 12 at 16.

Vacuum duct 12 joins vacuum chamber 13 at vacuum port 17. Vacuum chamber 13 has an enclosed top 18, enclosed sides 19 and 20, and rear wall 21, and is open at the front, as shown at 22; said opening may be selectively sealed off by vertically operable door 23, controlled, in this embodiment, by pneumatically operated cylinder 24 and piston rod and linkage 25. Intake port 26 is formed through bottom 27 of vacuum chamber 13 and, with door 23 in the closed position, provides the only access into vacuum chamber 13. As illustrated herein, door 23 is guided by tracks **28*a* and 28*b* during opening and closing operations, while cross-brace 29 and descending brace 30 provide a rigid support structure for door 23 and air cylinder and linkage 24 and 25. Intake port 26 has collar 31 extending therefrom to provide a mounting point for bag 32**.

Figure 4:
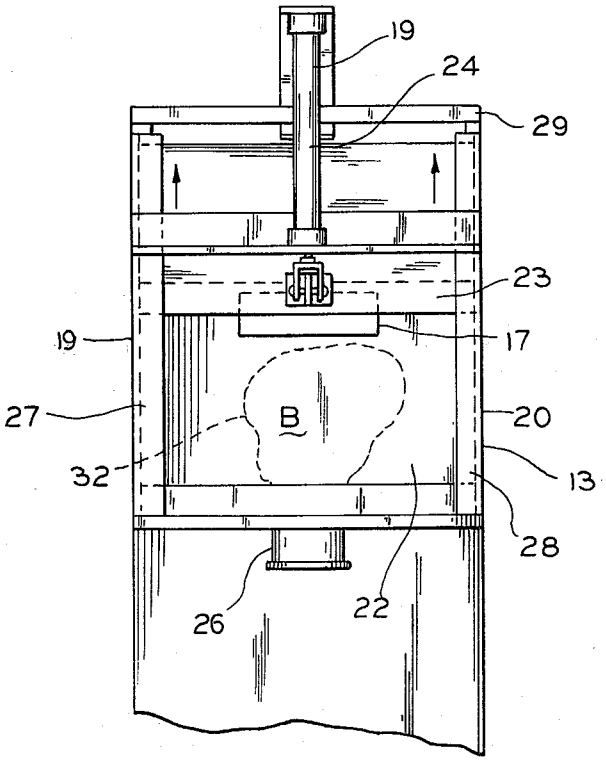
FIG. 4 is a partial front elevation illustrating reversal of the bag.
Figure 3:
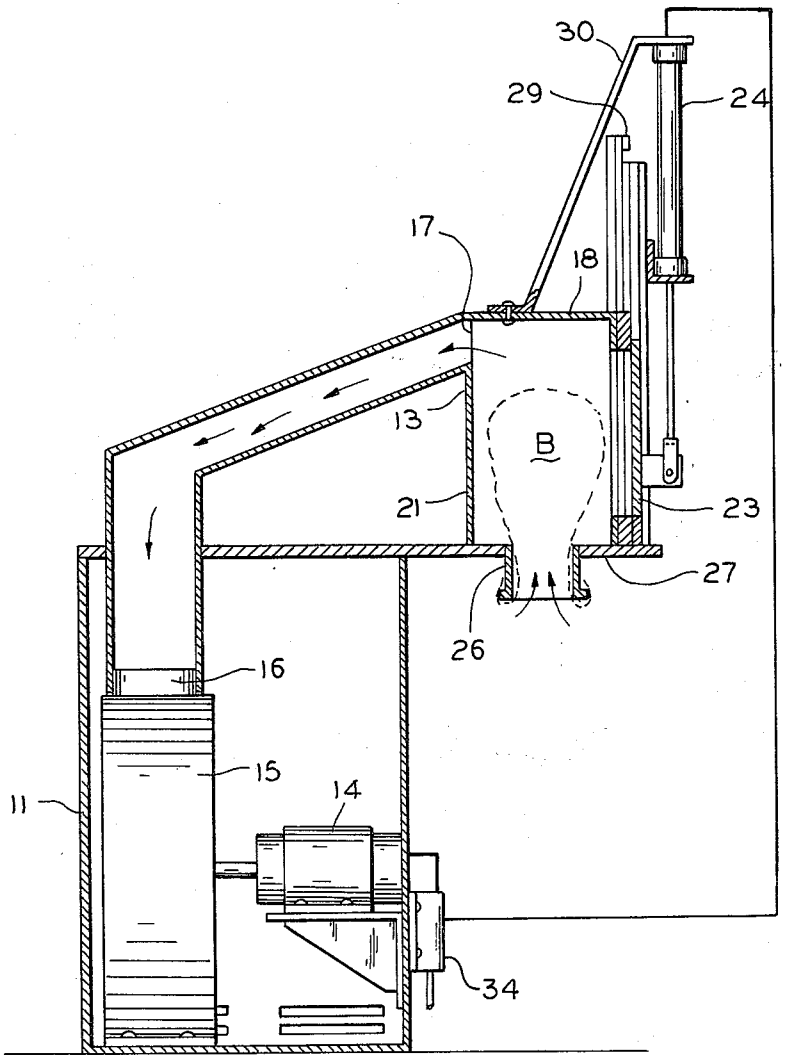
FIG. 3 is a side sectional view illustrating the bag as reversed.

Operation of vacuum unit 10 may be described as follows. Port 26 is inserted through an opening of bag 32, and bag 32 is partially tucked into the opening of collar 31 on entry port 26, as illustrated in FIG. 2. In this illustration, bag 32 is illustrated with side A exposed; turning the bag inside out, or reversing it, will ultimately expose side B. When bag 32 is in place, foot pedal 33 is depressed, activating air cylinder 24 to close door 23. Blower 14 is then actuated to exhaust air from chamber 13 through fan housing 15 and along vent 12, thereby creating a partial vacuum in chamber 13. The pressure differential between atmospheric pressure and the partial vacuum created in chamber 13 is sufficient to draw bag 32 through port 26, thereby reversing it to expose side B, as illustrated in FIG. 3. Blower 14 is then turned off, and air cylinder 24 actuated to open door 23, enabling the bag to be removed through doorway 22, as illustrated in FIG. 4.

The individual steps in the sequence hereinabove described may be separately controlled by the operator, or may, through the adaptation of control elements, old and well known in the art designated generally and schematically at 34 of FIG. 3, be conducted as an automatic sequenced operation once foot pedal 33 has been depressed.

After bag 32 has been removed from unit 10, another bag may be placed on collar 31 at port 26 and the process repeated. Bags thus processed are thus ready to be filled with stuffing, later to be sealed, packaged, and readied for shipment or entry into inventory.

Use of unit 10 enables a single operator to reverse many more bags per hour than could be reversed manually. This is particularly important when the bag openings are small relative to the remaining bulk of the bag, or when the bag is formed in a somewhat unusual and unconventional shape, making the "inside-out" operation difficult if not impossible to achieve manually. An awkward and tiring manual operation is thus supplanted by one which even employees of limited physical strength may do easily and efficiently.

While the invention has been hereinabove described in connection with a specific embodiment, it is to be understood that this embodiment is presented by way of example only. It is expected that others, skilled in the art, will perceive variations which, although different from the foregoing, do not depart from the spirit and scope of the invention as herein claimed.

I claim:

1. Apparatus for reversing panelized bag structures, said device comprising:

an enclosed chamber having a bottom panel, a top panel, a front panel, a rear panel, and side panels, said bottom panel having a passage formed therethrough communicating the interior of said enclosed chamber with the atmosphere;

an upstanding collar, said collar positioned at said passage on the exterior of said bottom panel;

an access door, said access door positioned on said front panel to selectively allow access to said enclosed chamber;

means for selectively establishing a partial vacuum within said chamber;

a vacuum duct, said duct communicating said vacuum means with said chamber; and structure to automatically control the opening and closing of said access door and the establishment of said vacuum in a sequence to first close said access door, establish the vacuum, and open said access door at selectable time intervals.

2. The apparatus as recited in claim 1 wherein said control means includes a switch having a first position and a second position, said switch, when moved to said first position, activating said control means to close said access door and establish said vacuum, and said switch, when moved to said second position, activating said control means to discontinue said vacuum and open said access door.

* * * * *